US008420939B2

(12) United States Patent
Hernandez-Hernandez et al.

(10) Patent No.: US 8,420,939 B2
(45) Date of Patent: Apr. 16, 2013

(54) FLAME RETARDANT, LOW SMOKE EMISSION, HALOGEN FREE 600 V ENERGY CABLE WITH POLYOLEFIN INSULATION AND POLYAMIDE JACKET

(75) Inventors: Juan Manuel Hernandez-Hernandez, Queretaro (MX); Alfonso Perez-Sanchez, Queretaro (MX)

(73) Assignee: Servicios Condumex S.A. de CV, Queretaro QRO (MX)

( * ) Notice: Subject to any disclaimer, the term of this patent is extended or adjusted under 35 U.S.C. 154(b) by 295 days.

(21) Appl. No.: 12/800,199

(22) Filed: May 10, 2010

(65) Prior Publication Data

US 2011/0174521 A1 Jul. 21, 2011

(30) Foreign Application Priority Data

Jan. 15, 2010 (MX) ..... MX/a/2010/000623

(51) Int. Cl.
*H01B 7/295* (2006.01)

(52) U.S. Cl.
USPC ..... 174/120 R; 174/121 A

(58) Field of Classification Search ..... 174/120 R, 174/120 SR, 121 A
See application file for complete search history.

(56) References Cited

U.S. PATENT DOCUMENTS

| | | | | |
|---|---|---|---|---|
| 6,472,015 | B1 * | 10/2002 | Hurley et al. | 427/207.1 |
| 2006/0226404 | A1 * | 10/2006 | Bauer et al. | 252/601 |
| 2008/0302556 | A1 * | 12/2008 | Varkey et al. | 174/120 R |

* cited by examiner

*Primary Examiner* — Chau Nguyen
(74) *Attorney, Agent, or Firm* — Carmen Pili Ekstrom

(57) ABSTRACT

Flame retardant, low smoke emission and halogen free energy cable with silane cross-linked polyolefin insulation and polyamide jacket for electrical installations up to 600 V, based on: a) an electric conductor core made of copper or aluminum; b) an insulating layer made of silane cross-linked polyethylene; and c) a flame retardant nylon-6 jacket with low smoke emission; characterized in that said core a) is based on a plurality of soft copper wires with electrical resistivity no greater than 17,241 nOhm.m (0.15328 Ohm.g/$m^2$) equivalent to a IACS 100% conductivity or aluminum with electrical resistivity not greater than 28,264 nOhm.m (0.07639 Ohm.g/$m^2$) equivalent to a IACS 61% conductivity and having reduced insulating thicknesses.

19 Claims, 2 Drawing Sheets

Figure 1:
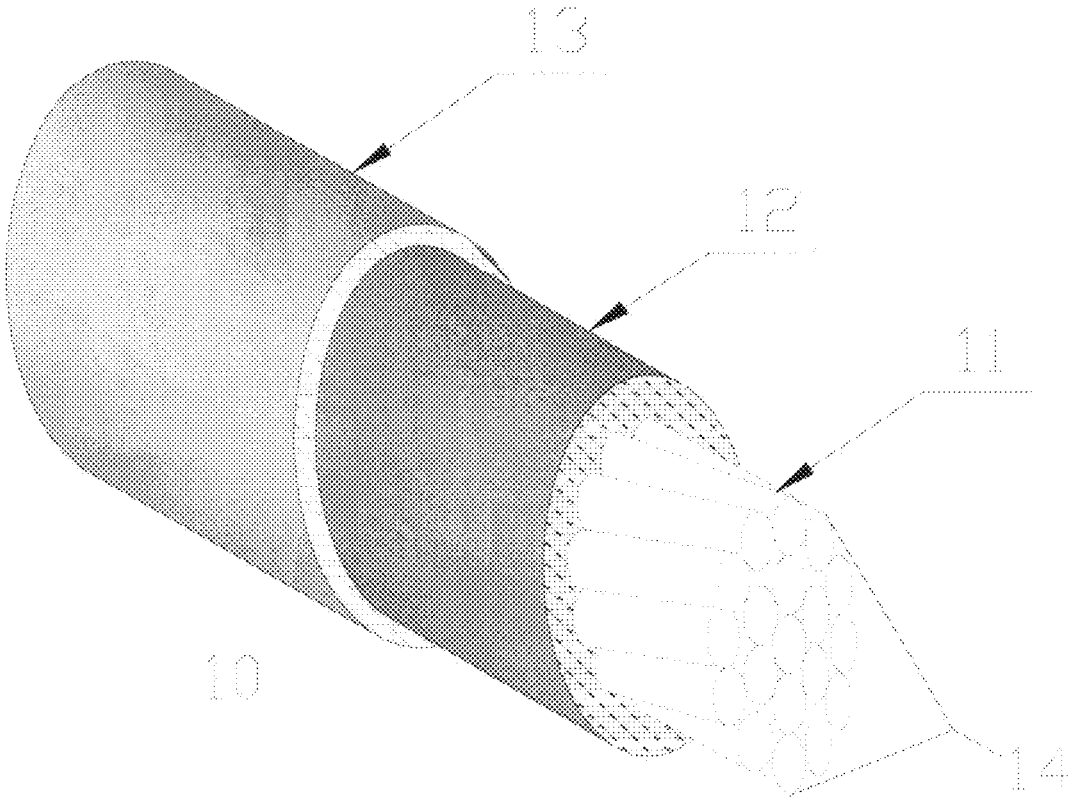

FLAME RETARDANT, LOW SMOKE EMISSION, HALOGEN FREE 600 V ENERGY CABLE WITH POLYOLEFIN INSULATION AND POLYAMIDE JACKET

BACKGROUND OF THE INVENTION

1. Field of the Invention

The invention relates to a flame retardant, low smoke emission, halogen free 600 V energy cable with polyolefin insulation and polyamide jacket, having improved performance properties as compared to common thermoplastic high heat-resistant nylon-coated (THHN) and thermoplastic high heat water-resistant-low smoke (THHW-LS) type cables, wherein the combined advantages result in a flame retardant having low smoke emission, halogen free cable, and resistant to aggressive environments, oils, greases and gasoline according to Mexican standard ANCE NMX-J-010-ANCE-2005.

2. Description of the Prior Art

Currently manufactured THHN-type cables are made of cable or wire copper or aluminum conductors, with polyvinyl chloride (PVC) based thermoplastic insulation and polyamide (nylon) jacket, said cables are appropriate for electrical installations of up to 600 V, resistant to abrasion, oils, greases, gasoline and chemical agents. Moreover, THHW-LS are cables with a copper conductor and polyvinyl chloride based insulation with flame retardant characteristics, low emission of obscure smoke and acidic gas fulfilling Mexican Standard ANCE NMX-J-010-ANCE-2005.

A thermoplastic high heat water-resistant-low smoke zero halogen (THHN-LSZH)-type cable was developed which combines the performance characteristics of both THHN and THHW-LS cable types with the combined advantages of both cable types: resistance to aggressive environments, oils, greases, and gasoline together with low smoke emission and resistance to flame propagation according to Mexican Standard ANCE NMX-J-010-ANCE-2005. Moreover, these new cables do not contain halogen that produces acidic gases when the cable is burnt.

Some cables are manufactured with insulation and other layers, thus forming multi-layer cables that act globally as composed material with unique properties resulting from the combination of the properties of the individual materials, as in this case the two layers: insulation conferring high performance electrical insulation properties and the nylon jacket conferring mechanical and chemical resistance properties.

The combination of both layers offers moreover flame retardancy, low smoke emission and halogen free composition. A disadvantage of the insulated cables based on PVC is that during their combustion, they emit acidic gases that are a health risk and a risk for the environment because they also corrode metals, said characteristic being especially important in areas where there could be equipment and instrument with components susceptible to corrosion.

There are some patents related to the invention, such as patent EP 0631 538 BI "IMPROVED FLEXIBLE FIRE RETARDANT MULTI-LAYER STRUCTURES COMPRISING POLYOLEFIN AND POLYAMIDE LAYERS AND PROCESS FOR MAKING SAME".

The instant invention presents advantages compared to the above mentioned patent, in that this cable generates low smoke emission measured as: specific maximum density, obscuration value due to fume during the first 4 minutes ($VOF_4$) and vertical tray flame test.

It is an object of the instant invention to supply a low smoke emission, halogen-free cable for electrical installations of up to 600 V THHN-LSZH type, Afumel trademark pending, the construction of said cable is as described hereinafter:

Copper or aluminum conductor, wire or cable;

Thermoset compound insulation based on flame retardant polyolefin cross linked through moisture;

Flame retardant polyamide (Nylon-6) jacket.

Because it has a nylon jacket, this cable shows reduced insulating thicknesses as in the case of THHN type cables but with THHW-LS cable properties with regard to low smoke emission (Maximum specific density Dm and obscuration value due to fume during the first 4 minutes ($VOF_4$), said characteristic cannot be fulfilled with a conventional THHN cable with a natural nylon jacket because the nylon, upon burning, generates a considerable amount of obscure smokes; this is not the case of the flame retardant nylon used in the THHN-LSZH cable that in this case also fulfills the vertical tray flame test as a complete cable.

DESCRIPTION OF THE INVENTION

Figure 2:
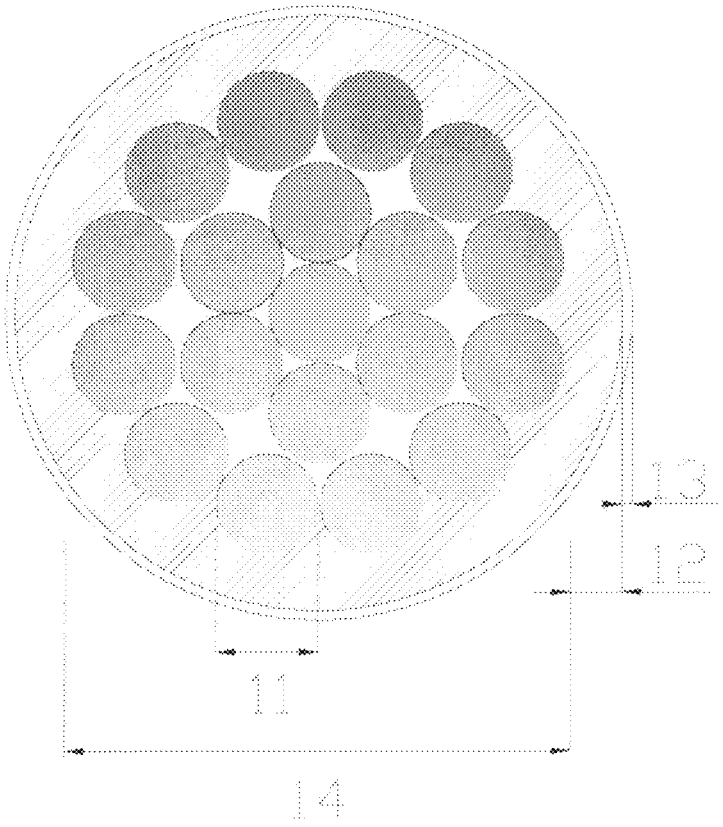

Hereinafter the invention is described according to the drawings of FIGS. 1 and 2, wherein:

FIG. 1 corresponds to a cross section perspective view of a THHN-LSZH Afumel type 600 V energy cable;

FIG. 2 corresponds to a cross section front view of the cable of FIG. 1.

The THHN-LSZH Afumel type 600 V energy cable 10, FIG. 1 and FIG. 2, object of the instant invention comprises:

a) an electric conductor core 11 made of copper or aluminum based on a plurality of wires 14. The conductors used can be individual wires or soft copper cables with electrical resistivity no greater than 17,241 nOhm.m (0.15328 Ohm.g/$m^2$) corresponding to an IACS 100% conductivity or aluminum with electrical resistivity not greater than 28,264 nOhm.m (0.07639 Ohm.g/$m^2$) equivalent to an IACS 61% conductivity, the cabled conductors are made of wire layers with combined alternate laying in the gauge range from 14 to 2 AWG and compressed laying in the gauge range from 1 AWG to 1000 MCM.

b) Then, the wire core comprising a layer 12 of anti-flame insulation based on a silane cross-linked polyethylene system (polyamide) comprising a mixture of: 90-99% parts of high density 100% natural resin and from 1 to 10% catalyzing additive (from 0.5 to 5.0% of tin dibutyl dilaurate, and from 0.5 to 7.5% of zinc stearate) providing thermal stability upon cross linking the (stripped) polyethylene chains transforming it in a thermoset material and flame retardant additive based on polyethylene resin mixed with phosphorus and nitrogen. The ratio of the components is constant independently of the thickness of the insulating layer indicated in Table No. 1; and c) A flame retardant nylon-6 jacket 13 with low smoke emission.

The jacket is based on non halogenated phosphorated flame retardant nylon-6 (6-aminohexanoic acid). The composition of this jacket is constant, independently of the thickness indicated in Table No. 1. The plastic cover of the cable is composed of two layers, the first layer being the insulating layer that is in contact with the conductor and based on an extruded silane cross-linked polyethylene system, the cross-linking or curing of the polyethylene is conducted through exposition to environmental moisture because of the components contained in its formulation. The preparation of silane cross-linked polyethylene is well known in the art. See for example, U.S. Pat. No. 3,646,155; U.S. Pat. No. 3,225,018 and GB1286460, the disclosures of which are incorporated herein by reference. The second layer, or jacket, is based on flame retardant nylon-6 and applied by tandem extrusion; i.e., in one single manufacturing line an extruder is used for the first insulating layer and thereafter on the same line, the second extruder is located that applies the nylon jacket. The thicknesses of the two layers, insulating layer and nylon jacket, are indicated in Table No. 1.

Hereinafter Table No. 1 describes the dimensional size of the THHN Afumel cable.

TABLE NO. 1

| THHN-LSZH Afumel type cable | Diameter of the stripped conductor (mm) | INSULATION THICKNESS Minimum mm | NYLON JACKET THICKNESS Minimum mm |
|---|---|---|---|
| 14 AWG 90° C. 600 V | 1.80 | 0.38 | 0.11 |
| 12 AWG 90° C. 600 V | 2.29 | | |
| 10 AWG 90° C. 600 V | 2.87 | 0.51 | |
| 8 AWG 90° C. 600 V | 3.63 | 0.76 | 0.14 |
| 6 AWG 90° C. 600 V | 4.53 | | |
| 4 AWG 90° C. 600 V | 5.70 | 1.02 | 0.16 |
| 2 AWG 90° C. 600 V | 7.20 | | |
| 1 AWG 90° C. 600 V | 8.18 | 1.27 | 0.19 |
| 1/0 AWG 90° C. 600 V | 9.19 | | |
| 2/0 AWG 90° C. 600 V | 10.31 | | |
| 3/0 AWG 90° C. 600 V | 11.58 | | |
| 4/0 AWG 90° C. 600 V | 13.00 | | |
| 250 Kcm 90° C. 600 V | 14.18 | 1.52 | 0.21 |
| 300 Kcm 90° C. 600 V | 15.53 | | |
| 350 Kcm 90° C. 600 V | 16.77 | | |
| 400 kCM 90° C. 600 V | 17.94 | | |
| 500 kCM 90° C. 600 V | 20.05 | | |
| 600 kCM 90° C. 600 V | 21.99 | 1.78 | 0.24 |
| 700 kCM 90° C. 600 V | 23.76 | | |
| 750 kCM 90° C. 600 V | 24.58 | | |
| 1000 kCM 90° C. 600 V | 28.39 | | |

Hereinafter, the manufacturing process of THHN-LS-ZH cable is described:

1) The electric conductor of the cable is conventionally manufactured through the standard drawing and joining processes of copper or aluminum wires.

2) Application of insulating and nylon jacket through tandem extrusion process, i.e., the two insulating layers are applied in one single step.

3) The insulating material is based on polyolefin that is chemically cross-linked through moisture. This cross-linking of the polymer chain is obtained through the addition of silanes; the final result is the obtaining of a thermoset compound, the mixture is prepared according to the following ratios:

Polyethylene-based resin: 90% to 99%

Catalyst: 1% to 10%

In the example mentioned hereinafter, the differences between THHN-LSZH and THHW-LS cables are shown.

EXAMPLE

With regard to electrical tests, the THHW-LS and THHN-LSZH cables fulfill practically the same requirements described in Table No. 2, the THHN-LSZH cables show long term insulating resistance values in water that are considerably better.

TABLE NO. 2

Characteristics of THHN-LS-ZH cables and THHW-LS cables

| Characteristic | Unit | THHN-LS-ZH cable |
|---|---|---|
| **Insulation properties** | | |
| Breaking tensile strength | MPa | 13.8 min. (*) |
| Tear strength | % | 150 min. (*) |
| Tensile strength after 168 h at 136° C. Retention | % | 85 min. (*) |
| Tear strength after 168 h at 136° C. Retention | % | 65 min. (*) |
| Heat deformation at 136° C. lh | % | 50 max |
| Thermal shock at 121° C. 1 hr. | — | Complies |
| Cold folding at −10° C. 1 hr. Without Tear | — | Complies |
| Oil immersion (4 h/70° C.) | — | |
| Retention under stress | % | 85 (*) |
| Elongation retention | % | 85 (*) |
| Flexibility 168 h/100° C., without breaking | — | Complies |
| Vertical tray flame test. Maximum damage must be below 2.44 meters | — | Complies |
| Moisture absorption electrical method at 75° C. | | |
| Dielectric constant after 24 hours of immersion at 3150 V/mm | — | 10 max |
| **Capacitance increase** | | |
| From 1 to 14 days | % | 10 max |
| From 7 to 14 days | % | 5 max |
| Long term insulation resistance >3 GOhm · m at 12 weeks or OGOhm · m at 24-36 weeks but >0.035 GOhm · m | — | Complies |

| Characteristic | THHW-LS cable | Test Method |
|---|---|---|
| **Insulation properties** | | |
| Tear tensile strength | 13.8 min. (*) | NMX-J-178 |
| Tear strength | 150 min. (*) | NMX-J-178 |
| Tensile strength after 168 h at 136° C. Retention | 85 min. (*) | NMX-J-186 |
| Tear strength after 168 h at 136° C. Retention | 65 min. (*) | NMX-J-186 |
| Heat deformation at 136° C. lh | 50 max | NMX-J-191 |
| Thermal shock at 121° C. 1 hr. | Complies | NMX-J-190 |
| Cold folding at −10° C. 1 hr. Without breaking | Complies | NMX-J-193 |
| Oil immersion (4 h/70° C.) | | NMX-J-194 |
| Retention under stress | 85 (*) | |
| Elongation retention | 85 (*) | |
| Flexibility 168 h/100° C., without breaking | Complies | NMX-J-194 |
| Vertical tray flame test. Maximum damage must be below 2.44 meters | Complies | UL-1581 |
| Moisture absorption electrical method at 75° C. | | NMX-J-194 |
| Dielectric constant after 24 hours of immersion at 3150 V/mm | 10 max | |
| **Capacitance increase** | | |
| From 1 to 14 days | 10 max | NMX-J-194 |
| From 7 to 14 days | 5 max | |
| Long term insulation resistance >3 GOhm · m at 12 weeks or 3 GOhm · m at 24-36 weeks but >0.035 GOhm · m | Complies | UL-83 |

(*) According to the standards said tests are conducted onto the cable without nylon cover.

Applications

Building cable in electric circuits up to 600 volts. Applications for building where safety characteristics are required such as: non propagation of flame, zero halogen and low smoke emission.

Cable Characteristics:

Maximum operation voltage: 600 V

Maximum operation temperature of the conductor in:

Dry environment: 90° C.

Wet environment: 75° C.

The THHN-LSZH cables offer:

Resistance to heat and moisture.

Resistance to oils.

They fulfill flame test VW-(1(UL1581), vertical tray flame test according to UL-1685 and Mexican Standard ANCE NMX-J-10-ANCE-2005.

Moreover they show advantages in: Savings and ease of installation: because the cable has reduced thicknesses as shown on Table No. 1, savings are generated with regard to the use of duct pipes and its nylon-6 jacket makes it easier to install it because of its sliding properties. In flame tests, the conventional THHN cables manufactured based on PVC insulation and natural nylon jacket generate a large amount of fumes because of their nylon jacket; on the other hand, the THHN-LSZH Afumel cable based on flame retardant nylon and low smoke emission fulfills low smoke emission values specified in Mexican Standard NMX-J-10 for the THHW/THHW-LS type cables.

The chemical compositions of the insulating compounds and jacket materials of the THHN-LS-ZH Afumel cable are heavy metals free, fulfilling thus the directive RoHS of the European Community (2002/95/EC).

The chemical compositions of the insulating compounds and jacket materials of the THHN-LSZH Afumel cable are halogen free and thus are environmentally friendly because they do not generate acidic gases.

TABLE NO. 3

Vertical Flame test and Maximum Specific density (DM)

| Characteristic | Test Method | Unit | Specified value | Obtained value for Cable THHN-LS-ZH |
|---|---|---|---|---|
| Vertical flame test (VW-1) Five flame applications 15 seconds each | NMX-J-192-ANCE | — | No burning paper flag indicator or cotton bed | Pass |
| Maximum specific optical density (DM) | NMX-J-474-ANCE | — | 500 max | 335 |
| Value of smoke obscuration in the first four minutes ($VOF_4$) | NMX-J-474-ANCE | — | 400 max | 355 |

The THHN-LSZH Afumel type cable shows better sliding characteristics as compared to THHN-LS cables and this translates into a greater ease of installation, avoiding the use of lubricant additives. The THHN-LSZH Afumel type cable has reduced insulating thicknesses and this translates into reduced final diameters, offering the advantage of inserting a larger number of conductors in the installation duct, or using a duct of smaller diameter with the corresponding savings with regard to the installation cost.

The above description is not intended to be exhaustive or to limit the invention to the precise form disclosed. Other modifications and variations are possible in the light of the teachings above without departing from the spirit and scope of the instant invention.

The invention claimed is:

1. A flame retardant, low smoke emission and halogen free 600 V energy cable with polyolefin insulation and polyamide jacket, comprising:

a) an electric conductor core comprising a plurality of wires selected from soft copper wires, aluminum or combination thereof;

b) a first layer comprising a thermoset insulating layer based on silane cross-linked polyethylene around the whole length of the conductor core; said first layer comprising a mixture based on 90-99% parts of polyolefin resin with flame retardancy based on polyethylene resin mixed with phosphorus and nitrogen, and from 1 to 10% of catalyst additive, and c) a second layer comprising a non-halogenated phosphorated flame retardant low smoke emission nylon-6 (6-hexanoic amino acid) jacket around the whole length of the first layer.

2. The flame retardant, low smoke emission and halogen free 600 V energy cable according to claim 1 wherein the soft copper wires have an electrical resistivity no greater than 17,241 nOhm.m (0.15328 Ohm.g/$m^2$) equivalent to a IACS 100% conductivity and aluminum have an electrical resistivity no greater than 28,264 nOhm.m (0.07639 Ohm.g/$m^2$) equivalent to a IACS 61% conductivity with reduced insulation thicknesses for several gauges AWG.

3. The flame retardant, low smoke emission and halogen free 600 V energy cable according to claim 2, further comprising a ratio of the components of the mixture comprising the insulating layer is kept-constant independently of the insulating layer or nylon jacket thickness.

4. The flame retardant, low smoke emission and halogen free 600 V energy cable according to claim 1, wherein the first layer further comprises minimum reduced insulating thicknesses are selected from a) from 0.38 mm for 18, 16, 14 and 12 AWG cables; b) from 0.51 mm for 10 AWG cables; c) from 0.76 mm for 8, 6 AWG cables; d) from 1.02 mm for 4, 2 AWG cables; e) from 1.27 mm for 1, 1/0, 2/0, 3/0, 4/0 AWG cables; f) from 1.52 mm for 250, 300, 350, 400 and 500 KCM cables; and g) from 1.78 mm for 600, 700, 750 and 1000 KCM cables; said thickness allowing a larger number of conductors in one installation duct.

5. The flame retardant, low smoke emission and halogen free 600 V energy cable according to claim 1, wherein the catalyst additive comprises a mixture of from 0.5 to 5.0% of tin dibutyl dilaurate and from 0.5 to 7.5% of zinc stearate.

6. The flame retardant, low smoke emission and halogen free 600 V energy cable according to claim 1, wherein the second layer further comprises minimum reduced insulating thicknesses selected from a) from 0.11 mm for 18, 16, 14, 12, 10 AWG cables; b) from 0.14 mm for 8, 6 AWG cables; c) from 0.16 mm for 4, 2 AWG cables; d) from 0.19 mm for 1, 1/0, 2/0, 3/0, 4/0 AWG cables; e) from 0.21 mm for 250, 300, 350, 400, 500 KCM cables; and f) from 0.24 mm for 600, 700, 750, 1000 KCM cables.

7. The flame retardant, low smoke emission and halogen free 600 V energy cable according to claim 1, further comprising a combination of the soft copper or aluminum electric conductors with alternate laying for gauges of from 14 to 2 AWG and compressed laying for gauges of from 1 to 1000 MCM.

8. The flame retardant, low smoke emission and halogen free 600 V energy cable according to claim 1, wherein the cable is halogen free and the cable generates low smoke emission measured as maximum specific density (Dm) obscuration value at 500 max, due to fume during the first four minutes ($VOF_4$) at 400 max and vertical flame test passes and produces no burning paper flag indicator or cotton bed in accordance with NMX-J-192 ANCE.

9. The flame retardant, low smoke emission and halogen free 600 V energy cable according to claim 1, wherein the cross-linking of silane cross-linked polyethylene is conducted through exposition to environmental moisture.

10. The flame retardant, low smoke emission and halogen free 600 V energy cable according to claim 1, wherein the second layer is applied by tandem extrusion.

11. The flame retardant, low smoke emission and halogen free 600 V energy cable according to claim 1, wherein the cable is heavy metal free and halogen free.

12. A method for preparing a flame retardant, low smoke emission and halogen free 600 V energy cable according to claim 1, comprising:

a) Providing a copper or aluminum electric conductor core comprising a plurality of soft copper wires and aluminum through standard drawing and joining process;

b) Applying through extrusion tandem process, a first layer comprising a thermoset insulating layer based on silane cross-linked polyethylene; said insulating layer comprising a mixture based on 90-99% parts of polyolefin resin with flame retardancy based on polyethylene resin mixed with phosphorus and nitrogen; and from 1 to 10% of catalyst additive; and c) Applying through second extrusion tandem process, a second layer comprising a non-halogenated phosphorated flame retardant low smoke emission nylon-6 (6-hexanoic amino acid) jacket; wherein said extrusion tandem process comprises applying the insulating layer and thereafter on the same line, the second extruder is located which applies the nylon jacket in one single step.

13. The flame retardant, low smoke emission and halogen free 600 V energy cable comprising:

a) an electric conductor core comprising a plurality of wires selected from soft copper wires, aluminum or combination thereof;

b) a first layer comprising a thermoset insulating layer based on silane cross-linked polyethylene around the whole length of the conductor core; said insulating layer comprising a mixture based on 90-99% parts of polyolefin resin with flame retardancy based on polyethylene resin mixed with phosphorus and nitrogen; and from 1 to 10% of catalyst additive; and c) a second layer comprising a non-halogenated phosphorated flame retardant low smoke emission nylon-6 (6-hexanoic amino acid) jacket around the whole length of the first layer; wherein said first and second layer are applied in one single step.

14. The flame retardant, low smoke emission and halogen free 600 V energy cable according to claim 13 wherein the catalyst additive comprises a mixture of from 0.5 to 5.0% of tin dibutyl dilaurate and from 0.5 to 7.5% of zinc stearate.

15. The flame retardant, low smoke emission and halogen free 600 V energy cable according to claim 13 wherein the cable is halogen free and generates low smoke emission measured as maximum specific density (Dm) obscuration value due to fume during the first four minutes ($VOF_4$) and vertical flame test.

16. The flame retardant, low smoke emission and halogen free 600 V energy cable according to claim 13 further comprising a combination of the soft copper or aluminum electric conductors with alternate laying for gauges of from 14 to 2 AWG and compressed laying for gauges of from 1 to 1000 MCM.

17. The flame retardant, low smoke emission and halogen free 600 V energy cable according to claim 13, wherein aluminum have an electrical resistivity no greater than 28,264 nOhm.m (0.07639 Ohm.g/$m^2$) equivalent to a IACS 61% conductivity with reduced insulation thicknesses for several gauges AWG.

18. The flame retardant, low smoke emission and halogen free 600 V energy cable according to claim 13 wherein the first layer further comprises minimum reduced insulating thicknesses selected from a) from 0.38 mm for 18, 16, 14 and 12 AWG cables; b) from 0.51 mm for 10 AWG cables; c) from 0.76 mm for 8, 6 AWG cables; d) from 1.02 mm for 4, 2 AWG cables; e) from 1.27 mm for 1, 1/0, 1/0, 2/0, 3/0, 4/0 AWG cables; f) from 1.52 mm for 250, 300, 350, 400 and 500 KCM cables; and g) from 1.78 mm for 600, 700, 750 and 1000 KCM cables; said thickness allowing a larger number of conductors in one installation duct.

19. The flame retardant, low smoke emission and halogen free 600 V energy cable according to claim 13, wherein the second layer further comprises minimum reduced insulating thicknesses selected from a) from 0.11 mm for 18, 16, 14, 12, 10 AWG cables; b) from 0.14 mm for 8, 6 AWG cables; c) from 0.16 mm for 4, 2 AWG cables; d) from 0.19 mm for 1, 1/0, 2/0, 3/0, 4/0 AWG cables; e) from 0.21 mm for 250, 300, 350, 400, 500 KCM cables; and f) from 0.24 mm for 600, 700, 750, 1000 KCM cables.

* * * * *